US010479666B2

(12) United States Patent
Forestelli et al.

(10) Patent No.: US 10,479,666 B2
(45) Date of Patent: Nov. 19, 2019

(54) SAMPLING CONTROL STATION FOR BOTTLES OR CONTAINERS FILLING PLANT

(75) Inventors: Fabio Forestelli, Alseno (IT); Alberto Cirio, Canelli (IT)

(73) Assignees: FT SYSTEMS S.R.L, Alseno (PC) (IT); AROL S.P.A., Canelli (AT) (IT)

( * ) Notice: Subject to any disclaimer, the term of this patent is extended or adjusted under 35 U.S.C. 154(b) by 702 days.

(21) Appl. No.: 13/395,866

(22) PCT Filed: Sep. 8, 2010

(86) PCT No.: PCT/IB2010/002253

§ 371 (c)(1),
(2), (4) Date: May 23, 2012

(87) PCT Pub. No.: WO2011/030207

PCT Pub. Date: Mar. 17, 2011

(65) Prior Publication Data

US 2012/0247064 A1 Oct. 4, 2012

(30) Foreign Application Priority Data

Sep. 14, 2009 (IT) ..... MI2009A 001571

(51) Int. Cl.
*B67C 7/00* (2006.01)
*B67B 3/26* (2006.01)

(52) U.S. Cl.
CPC ..... *B67B 3/261* (2013.01)

(58) Field of Classification Search
CPC ..... B67C 3/007; B67B 3/261
(Continued)

(56) References Cited

U.S. PATENT DOCUMENTS 2,106,365 A * 1/1938 Tiano ..... B67B 3/2033 53/306
3,683,598 A * 8/1972 Van Zijp ..... B67B 3/2073 53/317

(Continued)

FOREIGN PATENT DOCUMENTS

DE 4343750 A1 9/1994
DE 102006062536 A1 7/2008

(Continued)

OTHER PUBLICATIONS

International Search Report dated Jan. 21, 2011.

*Primary Examiner* — Michelle Lopez
*Assistant Examiner* — Chinyere J Rushing-Tucker
(74) *Attorney, Agent, or Firm* — Hedman & Costigan, P.C.; James V. Costigan; Kathleen A. Costigan

(57) ABSTRACT

The sampling control station comprises at least one grasping and transporting group (22) for picking up containers or bottles (16) from conveying means (18) and transporting them to at least one measuring module (21',21",21'"), the containers or bottles (16) being provided with a body tapered into a neck and ending with a mouth, wherein an annular ribbing (19) is foreseen at the mouth, and it is characterized in that the grasping and transporting group (22) comprises gripping means (23) connected to a mobile support structure (30), the gripping means (23) being mobile between a gripping position, in which they are engaged with the neck of the container (16) at and below the annular ribbing (19), and a release position in which they are not engaged with the container (16).

11 Claims, 5 Drawing Sheets

(58) Field of Classification Search
USPC ..... 53/167, 75, 76, 317, 331.5, 52, 502; 73/862.191, 427, 433, 299; 356/414, 356/429–431, 402–425
See application file for complete search history.

(56) References Cited

U.S. PATENT DOCUMENTS 4,459,843 A * 7/1984 Durham ..... G01M 3/3236 73/37
4,464,884 A * 8/1984 Franks ..... B65B 59/02 198/415
4,691,496 A * 9/1987 Anderson ..... B65B 57/10 53/282
4,907,700 A * 3/1990 Bankuty et al. ..... 209/546
5,581,975 A 12/1996 Trebbi
6,158,196 A * 12/2000 Trebbi et al. ..... 53/331.5
6,226,081 B1 * 5/2001 Fantone et al. ..... 356/239.6
6,679,026 B1 * 1/2004 Cirio ..... B67B 3/2033 53/317
6,800,818 B2 * 10/2004 Balboni ..... B65B 3/003 141/83
7,082,739 B2 * 8/2006 Guernieri ..... B67B 3/2033 53/317
9,850,015 B2 * 12/2017 Hayashi ..... B41J 2/2114
2003/0154688 A1 * 8/2003 Lang ..... B67B 3/2033 53/75
2004/0065049 A1 * 4/2004 Cirio ..... B67B 3/2033 53/317
2005/0284103 A1 * 12/2005 Hartness et al. ..... 53/136.1
2005/0284731 A1 * 12/2005 Hartness ..... B67C 3/225 198/465.4
2006/0272284 A1 * 12/2006 Galimberti ..... B67B 3/28 53/75
2007/0107801 A1 * 5/2007 Cochran ..... B65B 3/36 141/153
2009/0293437 A1 * 12/2009 Schulz et al. ..... 53/490
2011/0064555 A1 * 3/2011 Stoiber ..... B65G 47/847 414/751.1
2015/0183538 A1 * 7/2015 Cenci ..... B67C 3/242 53/281

FOREIGN PATENT DOCUMENTS

DE 1020080074238 A1 8/2009
EP 0328249 A1 8/1989

* cited by examiner

SAMPLING CONTROL STATION FOR BOTTLES OR CONTAINERS FILLING PLANT

The present invention refers to a sampling control station for a containers or bottles filling plant and to a containers or bottles filling plant comprising the same.

Conventional filling lines of bottles or containers made from plastic, like for example PET, HDPE, PE and so on, containing any kind of liquid, are generally made up of a bottles or containers filling station, followed by a closing and/or capping station of the bottles or containers, as well as by one or more control stations arranged downstream of the closing station.

The filling and closing stations in turn comprise a plurality, respectively, of taps or filling valves and of closing and/or capping heads of the mechanical or electronic type depending on the particular embodiment of the plant.

The filling and closing/capping stations are initially calibrated or set electronically so as to obtain the desired result in output in terms of filling and closing, depending on the particular container that it is wished to treat.

The actual obtaining of the set filling and closing parameters is then monitored by the possible control stations arranged downstream, through which it is possible to inspect the filled bottles or containers, determining whether they do or do not have the filling and closing characteristics that are wished to be obtained.

In particular, according to the specific implementation of the filling line, the control stations make it possible to verify the fill level, the position of a possible cap with respect to the bottle or the container, the tension of the container in response to a pressure exerted and so on.

In addition to the online control, it is necessary—in particular for quality standard requirements—to carry out sampling control of the containers that have passed the line control.

Currently, sampling control generally takes a measurement of the removal or unscrewing torque and of the reclosing angle, a measurement of the weight of the filled and sealed container, a measurement of the gas content and/or pressure of such a container and a measurement of the colour of the filling liquid, as well as other controls determined based on the specific application requirements. Sampling control stations currently known therefore comprise one or more of the respective measurement modules.

In order to carry out the sampling control the containers are generally picked up at predetermined intervals.

At present such picking up of the treated containers to subject them to sampling control mainly takes place manually in order to transfer them to the single measurement modules.

However, sampling control stations provided with automated pick-up means are also known.

Such known pick-up means pick up the container laterally at the middle of the bottle body, preferably at the height of the barycentre of the container or, if present, at an annular recess of the body thereof.

Therefore, it is necessary to set the gripping means each time to suit the dimensions (height and diameter) of the particular container to be picked up.

In relation in particular to the measurement of the removal torque and/or of the reclosing angle, the measurement tools must be perfectly in line with the closing cap of the container in order to be able to carry out a correct measurement.

For this purpose, the gripping means used in sampling stations currently known must be moved in a different way each time depending on the dimensions of the container (diameter), so that a perfectly aligned positioning is always ensured.

Therefore, every time that the dimensions of the bottle or container treated by the filling line change, there needs to be an intervention by a worker on the sampling control station currently known in order to mount the most suitable gripping means and set its movements.

Last but not least, currently known sampling control stations have substantial bulk, in general depending upon the number of control modules used, and they do not usually allow the tested containers to return to the line in an automated manner.

The purpose of the present invention is to avoid the aforementioned drawbacks and in particular to devise a sampling control station for bottles or containers filling plants that can operate fully automatically irrespective of the dimensions of the treated bottle or container.

Another purpose of the present invention is to provide a sampling control station for bottles or containers filling plants that ensures positioning centred on the respective measurement modules without the need for settings dependent upon the dimensions of the container.

A further purpose of the present invention is to make a sampling control station for bottles or containers filling plants capable of reinserting the tested containers to the line in an automated manner.

The last but not least purpose of the present invention is to devise a containers or bottles filling plant provided with such a sampling control station.

These and other purposes according to the present invention are accomplished by making a sampling control station for a containers or bottles filling plant and by a containers or bottles filling plant comprising the same as outlined in the independent claims.

Further characteristics of the sampling control station and of the filling plant are the object of the dependent claims.

The characteristics and advantages of a sampling control station for a containers or bottles filling plant according to the present invention will become clearer from the following description, given as an example and not for limiting purposes, referring to the attached schematic drawings, in which.

Figure 1:
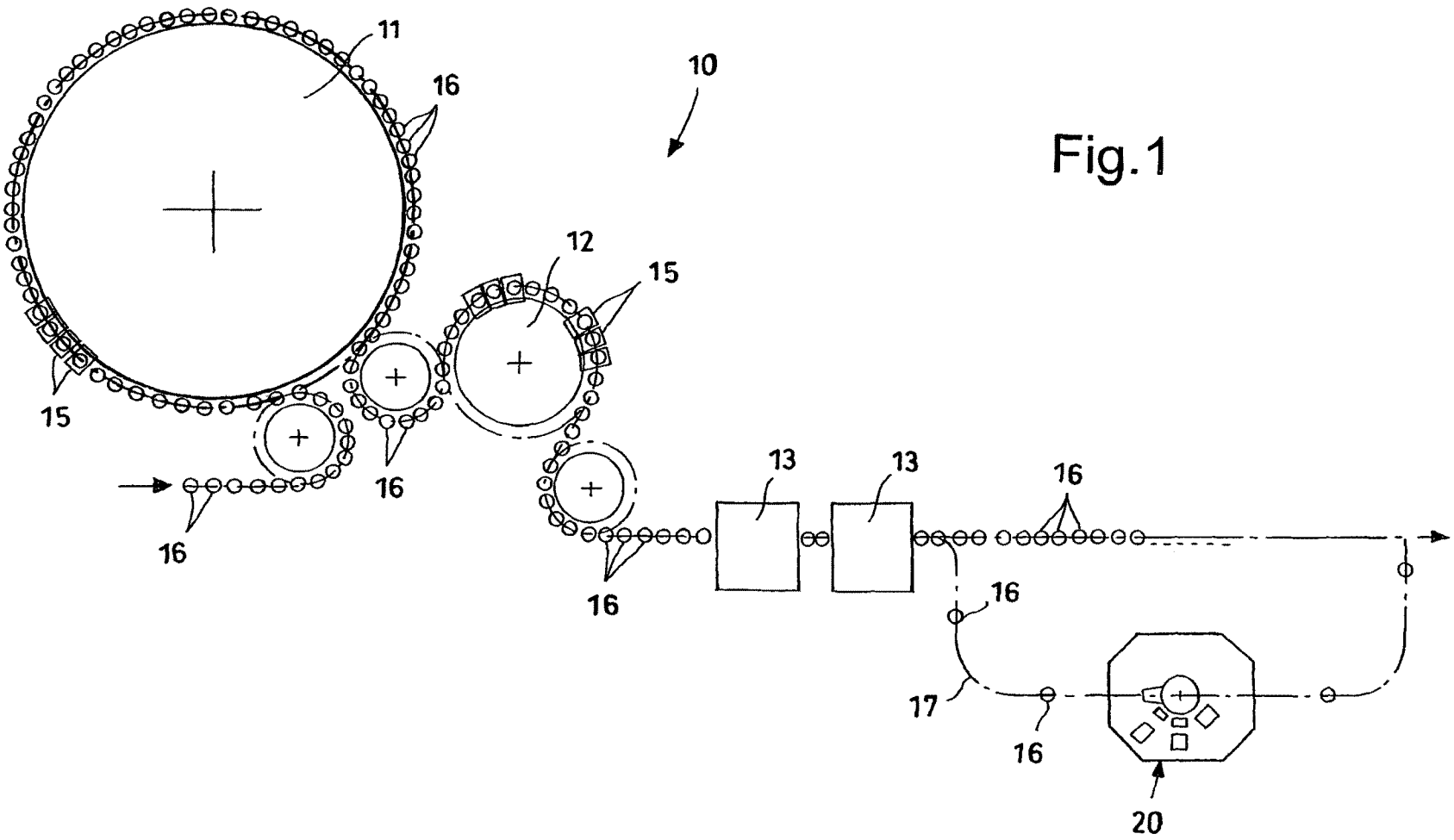
FIG. 1 is a schematic plan view of a preferred embodiment of the containers or bottles filling plant according to the present invention.
Figure 2:
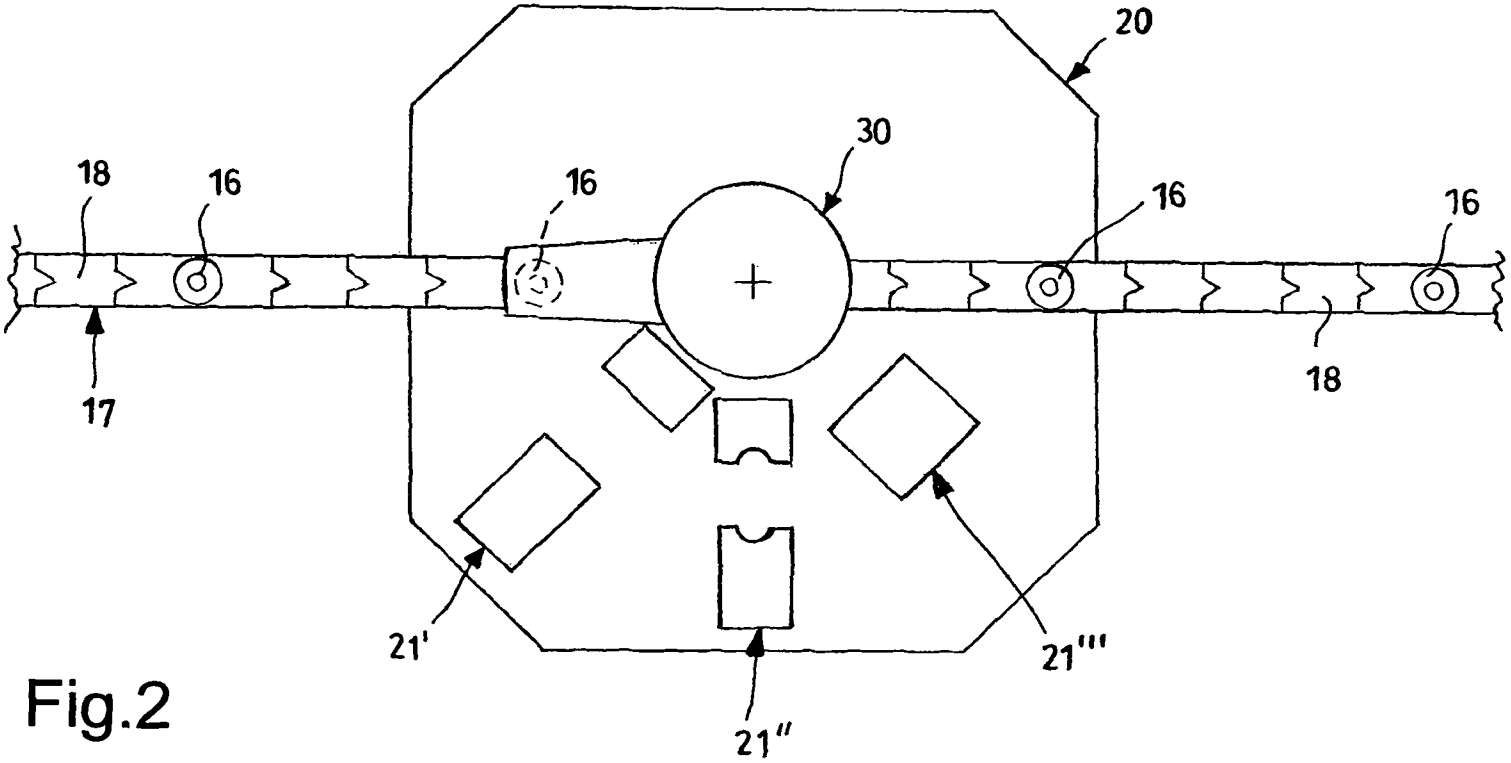
FIG. 2 is a plan view of a preferred embodiment of the sampling control station according to the present invention.
Figure 3:
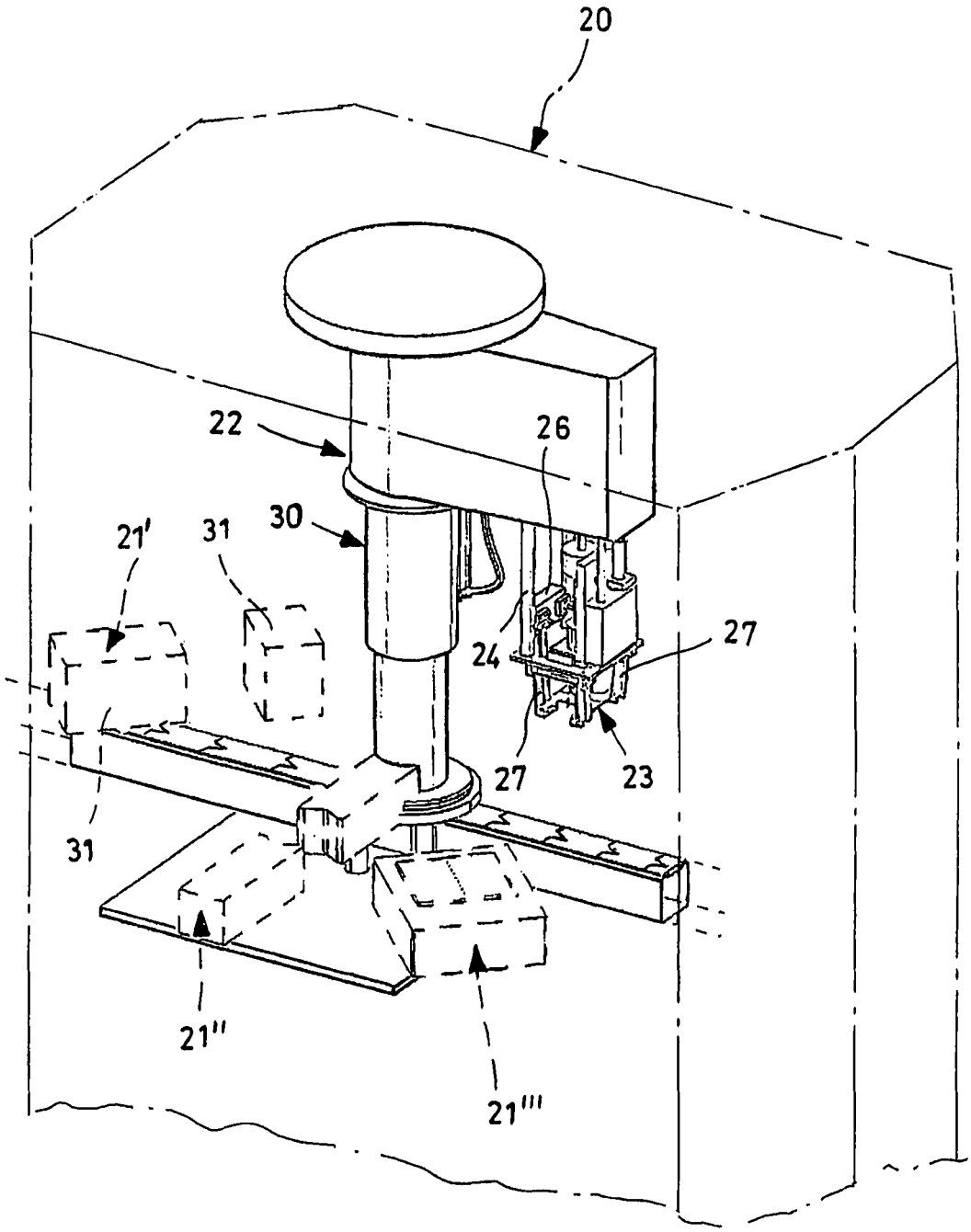
FIG. 3 is a schematic perspective view of the grasping and transporting means of the sampling control station according to the present invention in which three measuring modules are represented in a simplified manner through a broken line.
Figure 4:
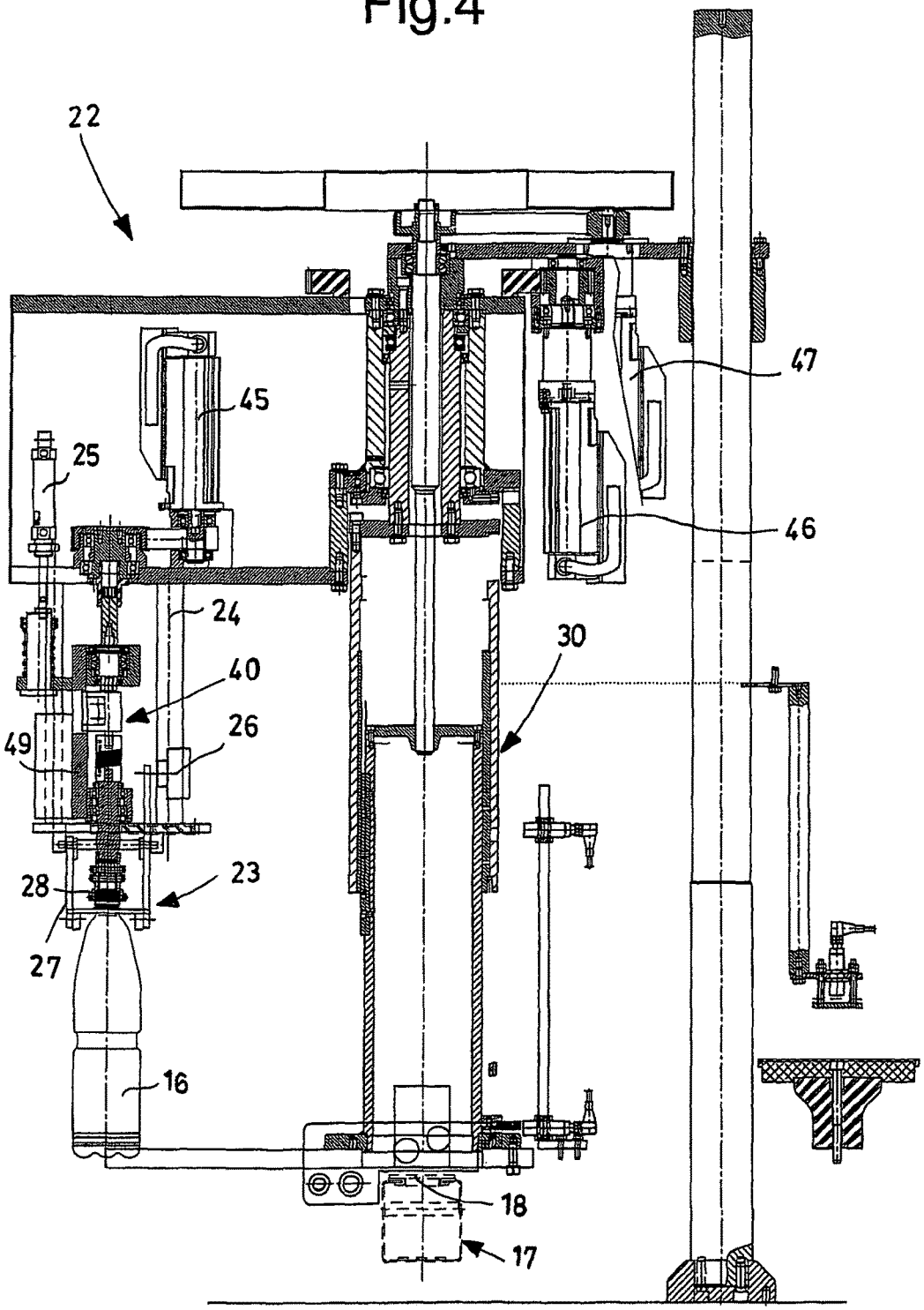
FIG. 4 is a partial section view of the grasping means of FIG. 3.
Figure 5:
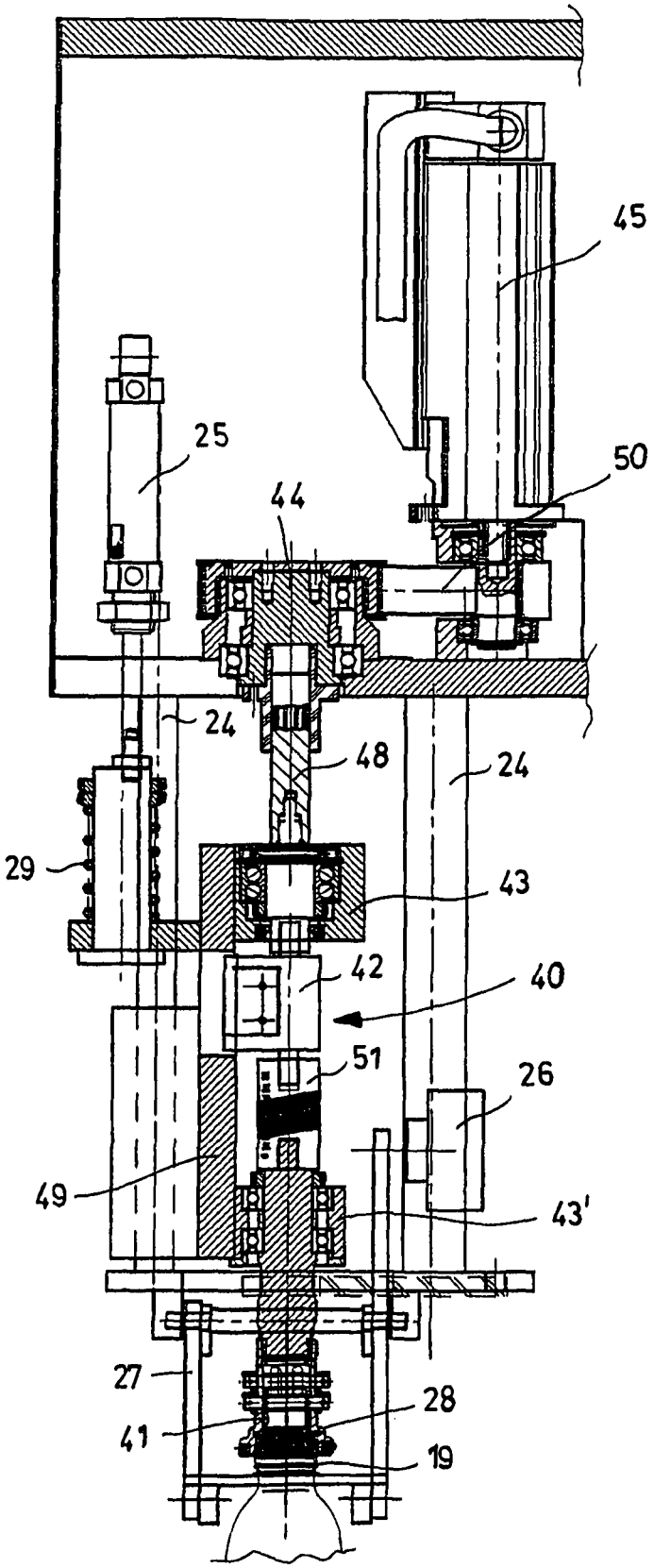
FIG. 5 is an enlarged detail of FIG. 4.

With reference to the figures, a containers or bottles filling plant is shown, wholly indicated with 10.

In particular, the plant 10 according to the present invention treats bottles or containers having a shape that tapers into a neck ending in a mouth, in which at the neck, near to the mouth, there is an annular ribbing 19, also known as crown or lip.

Such a plant comprises a first station 11 for filling bottles or containers 16, followed by a second station 12 for closing and/or capping the bottles or containers 16.

The filling and closing stations in turn comprise a plurality, respectively, of taps or filling valves 15 and of closing and/or capping heads 14 constrained to move forward along the periphery of the respective first and second station 11,12 so as to follow the bottles being treated for a section, filling and/or capping them in movement.

Preferably, the first 11 and the second 12 station have a circular configuration, in which the taps or filling valves 15 and the closing and/or capping heads 14 are connected to the periphery of a turntable or carousel. Such stations 11,12 can for example be provided respectively with about 80 taps or filling valves 15 and with about 20 closing and/or capping heads 14.

The containers or bottles 16 are transported through special conveying means, like for example a set of conveying means connected and free on a conveyor belt 18, along a path that at least partially follows the periphery of the first 11 and second 12 station.

Downstream of the second station 12 with respect to the direction of forward movement of the container 16 at least one control station 13 is foreseen in addition. Downstream of the at least one control station 13 there are also advantageously deviator means (not illustrated) which, at predetermined intervals, direct a subset of containers towards a secondary branch 17 along which a sampling control station 20 is arranged. Preferably, the secondary branch 17 is configured like a by-pass branch so as to be able to reinsert the containers 16 whose characteristics, from the sampling measurements, fall within the required ranges back into the line.

The sampling control station 20 comprises at least one measuring module 21',21",21'" through which one or more parameters of a container 16 indicative of the correct operation of the taps or filling valves 15 and/or of the capping heads 14 are verified.

For example, to control the taps or filling valves 15 it is possible to use a module for measuring the fill level or a module for measuring the weight of the container 16.

To control the capping heads 14, on the other hand, it is possible to use a module for measuring the capping height or a module for measuring the reclosing angle and/or the removal torque of the capsule or cap 28 of the container 16.

In the case of measurement of the removal torque and/or of the reclosing angle, a module for measuring the gas content and/or pressure is also advantageously foreseen arranged so as to carry out the measurement immediately after the measurement carried out by the module for measuring the removal torque and/or the reclosing angle to verify that during the control step of the screwing the container 16 has been correctly closed up.

Finally, the sampling control station 20 can advantageously also be equipped with a module for measuring the colour made for example through suitable colorimeters.

The module for checking the fill level can be implemented with various technologies, according to the container 16 and the liquid to be checked, the speed and the precision required. Normally a high-frequency module or high-frequency capacitive module, generally used for all food liquids, is used: the bottles pass through a measurement bridge made up of two metal plates that oscillate at high frequency. The plates are suitably connected to an electronic board dedicated to the measurement of the variation in frequency or capacity as the bottles pass. The variations are proportional to the amount of liquid. The detected values, suitably filtered and amplified, are processed by a processing unit (not illustrated) in order to evaluate whether to accept or discard the container 16 under analysis.

Alternatively, to make the module for measuring the fill level it is possible to use an X-ray source generally used for all types of containers and liquids.

Such an X-ray source is made up of a generator intended to emit a beam of rays capable of penetrating the passing bottles and striking a reception sensor known as scintillator. According to the amount of rays striking the receiver, a processing unit (not illustrated) is able to evaluate whether to accept or discard the container 16 under analysis.

In order to check the fill level it is also possible to use industrial video cameras. The video camera correlated to a suitable lighting system, takes a photograph of all the samples under analysis and suitable software means for processing images calculate the fill level determining whether to accept or discard the container 16.

The module for measuring the weight preferably comprises a metrically approved balance in order to provide an exact measurement of the weight of the filled container 16, also able to be used for certification purposes.

The module for measuring the capping height preferably comprises industrial video cameras correlated to a suitable lighting system that take one or more photographs of the containers under analysis. From electronic processing of the images the capping height can be determined and it can be decided whether to discard or accept the container 16.

Finally, the module for measuring the gas content and/or pressure can for example be implemented through a pressure transducer made using different technologies such as linear or proximity transducers, load cells, lasers, and so on. Whether to accept or discard the container 16 is determined based on suitable processing of the values detected by the transducer.

According to the present invention, the sampling control station 20 in addition comprises at least one grasping and transporting group 22 acting upon the container 16 near to its mouth.

In particular, the grasping and transporting group 22 comprises a mobile support structure 30 to which gripping means 23 able to move between a gripping position, in which they are engaged with the neck of the container 16 at and below the annular ribbing 19 foreseen near to the mouth of the container 16, and a release position are connected.

In this way, it is not necessary to specifically set the grasping and transporting groups 22 each time the configuration of the containers 16 treated through the filling plant 10 changes.

Indeed, the size and configuration of the necks of the containers 16 generally have minimal variations that can be managed through the same grasping means 23. Therefore, the same grasping and transporting groups 22 can be used for a large number of containers 16 having a different configuration of the body.

The connection of the gripping means 23 to the mobile support structure 30 makes it possible to pick up the container 16 from the conveyor belt 18, transporting it to at least one measuring module 21',21",21'" to then take it back again to the conveyor belt 18 once the measurement has been carried out and no anomaly has been detected.

Preferably, the support structure 30 is of the rotary type with centre of rotation arranged at a position of the conveyor belt 18, and the measuring modules 21',21",21'" are arranged along the circumference described by the movement of the gripping means 23 when moved by the mobile support structure 30.

For this purpose, the mobile support structure 30 is set in rotation through a first actuator 46. In addition, the mobile support structure 30 is set in vertical translation through a second actuator 47 in order to carry out an initial adjustment of the suspension height of the gripping means 23, dependent upon the particular container to be treated 16.

Both the first 46 and second 47 actuators are preferably of the brushless type.

According to a preferred embodiment, the gripping means 23 grip from above, defining a gripping mouth having a vertical axis in their open configuration.

Such gripping means 23 can for example be made as a pincer and be able to be actuated through movement means 26,27 that preferably comprise a third actuator 26 that acts upon a lever mechanism 27 to open and close them 23.

Once a container 16 has been hooked by the grasping and transporting group 22 according to the present invention, such a grasping and transporting group 22 is perfectly aligned with the cap 28 of the container 16. Moreover, since the distance between the cap and the ribbing 19 at which the engagement of the gripping means 23 takes place, substantially the same for the majority of types of containers 16, the position of the cap 28 is also well known thanks to the grasping and transporting group 22 used in the sampling control station 20 according to the present invention.

In order to better exploit such aligned positioning, according to a preferred aspect of the present invention, the grasping and transporting group 22 is connected to a module 40 for measuring the removal torque and/or the reclosing angle of the cap 28 of the container 16.

The measuring module 40 comprises a first part that can translate vertically with respect to the transporting group 22 and a second part fixed in translation with respect to such a group 22.

The first translatable part 41,43,43',49,48 of the measuring module 40 comprises coupling means 41 with a cap 28 arranged near to the gripping means 23, in which such means 41 are mobile between a first position engaged with the cap 28 and a second position disengaged from the cap 28.

The means 41 for coupling with a cap can for example be made through a positive coupling cone 41 having a flared coupling portion or else by a pincer (not illustrated) able to be adapted to the diameter of the cap 28, like a pincer provided with spring-loaded jaws that clamp onto the surface of the cap 28.

The means 41 for coupling with the cap 28 are connected on top to a slide 49 through two bearing blocks 43,43' mounted on a vertical shaft 48 that allows the relative rotation between such coupling means 41 and the slide 49.

The slide 49 is in turn connected to a support guide 24 and is set in vertical translation along the guide 24 by a fourth actuator 25.

The fourth actuator 25 preferably has elastic means 29 coupled with it that compress once the coupling means 41 reach the cap 28 of the container 16, thus limiting the thrusting action transferred by the fourth actuator 25.

On top of the means 41 for coupling with the cap 28 a torsion sensor 42 is also arranged, like for example a torque meter, to measure the torque necessary to start unscrewing the cap 28. Preferably, the torsion sensor 42 is arranged between the two bearing blocks 43,43'. Preferably, the vertical shaft 48 is interrupted by an elastic joint 51 suitable for decoupling the torsion sensor 42. Such an elastic joint 51 can be positioned above or below such a torsion sensor 42.

The second part fixed in translation 44 of the module 40 for measuring the removal torque and/or the reclosing angle of the cap 28 comprises a hub 44 in which the vertical shaft 48 connected to the first translatable part 41,43,43',49,48 is free to slide along the vertical axis.

The hub 44 is set in rotation through a fifth actuator 45, preferably a brushless motor, through a belt transmission 50, and in turn transfers a rotation torque to the vertical shaft 48 of the first translatable part that for this purpose has grooves (not illustrated) that go into coupling with the rotary part of the hub 44.

The fifth actuator 45 comprises, fitted directly onto the drive shaft, an encoder (not illustrated) for measuring the rotation angle of the vertical shaft 48 when the cap 28 is made to close.

Once the gripping means 23 are engaged with a container 16 they are able to give such a container 16 a reaction torque of sufficient size to unscrew and then close back up the cap 28.

In such a gripping configuration the module 40 for measuring the removal torque and/or the reclosing angle of the cap 28 is lowered from an elevated position along the guide 24 until it comes into contact with the cap 28 of the container 16.

In this way the simultaneous measurement of the removal torque and of the reclosing angle given by the capping and/or closing heads 14 of the second station 12 takes place.

The operation of the sampling control station 20 for a bottles or containers filling plant 10 is the following.

Every predetermined time period, the deviator means arranged along the filling line divert a container 16 towards the secondary branch 17 along which the sampling control station 20 is arranged.

The diverted container 16 moves forward towards the sampling control station 20 and, once reached, it is picked up by the grasping and transporting group 22.

For this purpose, the gripping means 23 are initially positioned, through the movement of the mobile support structure 30, at a pick-up point of the container 16 along the conveying line 17, and once the container 16 is present, they are brought up to the neck of the container 16 and in particular positioned so as to go into engagement with the annular ribbing 19 present at the mouth of the container 16.

Once the container 16 has been gripped beneath the annular ribbing 19, the gripping means 23 are translated upwards again through the movement of the mobile support structure 30.

The mobile support station 30 transports the set consisting of the gripping means 23 and the container to a first measuring module 21' where a first analysis takes place.

The container 16 is then moved to a second measuring module 21" and so on for every measuring module present in the sampling control station 20.

If the grasping and transporting groups 22 in addition comprise, connected to them, a module 40 for measuring the removal torque and/or the reclosing angle of the cap 28 of the container 16, such a module 40 is able to carry out a measurement at any position in which the container 16 is taken. For this purpose, the module 40 for measuring the removal torque and/or the reclosing angle of the cap 28 firstly applies a torque sufficient to start unscrewing it, at the same time measuring the amount of torque necessary for such unscrewing, and then it takes care of screwing the unscrewed cap back on with a predetermined torque value, measuring the angle necessary to clamp it again.

Preferably, after the measurement of the removal torque and of the reclosing angle of the cap 28 there is a control of the gas content and/or pressure in order to verify that during the previous control the gas content and/or pressure possibly measured on the line by one of the third control stations 13 were not modified.

Once all of the measurements have been made and in the case in which no anomalies are found, the mobile support structure 30 positions the gripping means 23 at a release point of the container.

Preferably, if the secondary branch 17 is configured like a by-pass branch, the release point of the container is arranged on the conveyor belt 18 downstream of the sampling control station 20 so as to be able to be automatically taken away and inserted back in the line.

Otherwise, in the case in which anomalies are found, the mobile support structure 30 positions the gripping means 23 at a discarding container (not illustrated) where the defective container 16 is released through the opening of the gripping means 23.

From the description that has been made the characteristics of the sampling control station for bottles or containers filling plants object of the present invention are clear, just as the relative advantages are also clear.

Indeed, the sampling control station is able to fully automatically pick up the containers from the conveyor belt substantially irrespective of their dimensions, since it is meant to pick up containers having certain neck dimensions. As known, the dimensions of the neck of containers, in particular bottle-type ones, do not have a high degree of variability, therefore being able to be managed by the same gripping means.

Moreover, the grasping and transporting groups used in the sampling control station according to the present invention ensure a centred positioning of the containers on the measurement modules irrespective of the dimensions of the containers. In the embodiments in which the container is gripped from above, the gripping means are always arranged coaxially with respect to the container. Therefore, the distance between the gripping point of the gripping means and the axis of the container does not depend upon the dimensions of the container since it is always equal to zero.

Last but not least, if the secondary branch on which the sampling control station is arranged is configured like a by-pass, such a station is able to reposition the analysed container onto the conveyor belt that therefore takes care of reinserting it into the line. Finally, the sampling control stations according to the present invention can house a plurality of measurement modules in small spaces thanks to the particular arrangement thereof along the circumference described by the movement of the gripping means. Moreover, by optionally foreseeing many grasping and transporting groups it is possible to manage many measurement modules simultaneously, therefore increasing the capacity of the station.

Finally, it is clear that the sampling control station for bottles or containers filling plants thus conceived can undergo numerous modifications and variants, all of which are covered by the invention; moreover, all of the details can be replaced by technically equivalent elements. In practice, the materials used, as well as the sizes, can be whatever according to the technical requirements.

The invention claimed is:

1. Sampling control station (20) for a container or bottle filling plant having a filling and closing station said sampling control station comprising at least one grasping and transporting group (22) for picking up containers or bottles (16) from conveying means (18) and transporting said containers or bottles to at least one measuring module (21', 21", 21'") said container or bottle (16) being provided with a body tapered into a neck and ending with a mouth, said neck having an annular ribbing (19), characterised in that said grasping and transporting group (22) comprises gripping means (23) being connected to a mobile rotary support structure (30) said mobile rotary support structure (30) having a centre of rotation arranged at said conveying means (18), said at least one measuring module (21', 21", 21'") being arranged along a circumference described by the rotational movement of said gripping means (23) through said mobile rotary support structure (30), said mobile rotary structure being adapted to pick up said container or bottle (16) from said conveying means (18) with said grasping and transporting group (22) and to transport said container or bottle (16) to said at least one measuring module (21', 21", 21'") to then take said container or bottle (16) back again to a release point of said conveying means (18) once measurement has been carried out and no anomaly has been detected or to then position said container or bottle (16) at a discarding container in the case in which anomalies are found, said gripping means (23) comprising a pincer adapted to be opened and closed through a lever mechanism (27), said gripping means (23) being mobile between a gripping position, in which they are engaged with said neck of said container (16) at and below said annular ribbing (19), and a release position in which they are not engaged with said container (16), gripping means (23) means being connected to and supported by mobile support structure (30) in order to perform a gripping from above the neck of container (16), wherein said mobile support structure (30) is vertically translatable in order to adjust the suspension height of said gripping means (23) means and wherein said sampling control station also includes a removal or reclosing module (40) for measuring a removal torque and/or a reclosing angle of a cap (28) of said container (16) connected to said grasping and transporting group (22) so as to be positioned above said gripping means (23).

2. Sampling control station (20) for a containers or bottles filling plant according to claim 1, characterised in that said gripping means (23) define a gripping mouth having a vertical axis.

3. Sampling control station (20) for a containers or bottles filling plant according to claim 1, characterised in that said removal or reclosing module (40) for measuring the removal torque and/or the reclosing angle of a cap (28) comprises a first part that can translate vertically with respect to said transporting group (22) comprising means (41) for coupling with said cap (28) arranged near to said gripping means (23) and mobile between a first position engaged with said cap (28) and a second position disengaged from said cap (28), said coupling means (41) being set in rotation so as to transfer a rotation torque to said cap, a torsion sensor (42) being arranged above said coupling means (41) to measure the torque needed to begin unscrewing said cap (28).

4. Sampling control station (20) for a containers or bottles filling plant according to claim 3, characterised in that said coupling means (41) are connected on top to a slide (49) able to translate vertically through two bearing blocks (43, 43') mounted on a vertical shaft (48) that allow the relative rotation between said coupling means (41) and said slide (49).

5. Sampling control station (20) for a containers or bottles filling plant according to claim 3, characterised in that said coupling means (41) are positive coupling cone (41) comprising a flared portion for coupling with said cap (28).

6. Sampling control station (20) for a container or bottle filling plant according to claim 1, characterised in that said at least one measuring module (21', 21", 21'") is chosen from the measuring modules belonging to the group consisting of:

a module for measuring the fill level;

a module for measuring the weight;

a module for measuring the capping height;

a module for measuring the colour;

a module for measuring gas content and/or pressure of said container (16).

7. Plant (10) for filling containers or bottles comprising conveying means (18) on which a plurality of containers or bottles (16) is moved along a direction of forward movement, with there being, arranged in succession along said direction of forward movement, a first filling station (11) of said containers or bottles (16), a second closing and/or capping station (12) of said containers or bottles (16) and at least one third station (13) for checking at least one filling parameter, characterised in that downstream of said at least one third control station (13), a secondary branch (17) of said conveying means is provided for sending said containers or bottles (16) to at least one sampling control station (20) according to claim 1.

8. Plant (10) for filling containers or bottles according to claim 7, characterised in that said secondary branch (17) is configured like a by-pass branch parallel to said direction of forward movement.

9. Plant (10) for filling containers or bottles comprising conveying means (18) on which a plurality of containers or bottles were (16) is moved along a direction of forward movement, with there being, arranged in succession along said direction of forward movement, a first filling station (11) of said containers or bottles (16), a second closing and/or capping station (12) of said containers or bottles (16) and at least one third station (13) for checking at least one filling parameter, characterised in that downstream of said at least one third control station (13), a secondary branch (17) of said conveying means is provided for sending said containers or bottles (16) to at least one sampling control station (20) at predetermined time periods according to claim 1.

10. Sampling control station (20) for a containers or bottles filling plant according to claim 1, characterised in that said removal or reclosing module (40) comprises a second part which is prevented from translating with respect to said transporting group (22), said second non-translating part comprising a hub (44) in which said vertical shaft (48) of said first translating part is free to vertically slide, said shaft (48) being connected to said hub (44) so that they cannot rotate one with respect to the other, said hub (44) being set in rotation and transferring a rotation torque to said vertical shaft (48).

11. Sampling control station (20) for a container or bottle filling plant having a filling and closing station said sampling control station comprising at least one grasping and transporting group (22) for picking up containers or bottles (16) from conveying means (18) and transporting said containers or bottles to at least one measuring module (21', 21", 21'") said container or bottle (16) being provided with a body tapered into a neck and ending with a mouth, said neck having an annular ribbing (19), characterised in that said grasping and transporting group (22) comprises gripping means (23) connected to a mobile support structure (30) said mobile support structure (30) having a centre of rotation arranged at said conveying means (18), said at least one measuring module (21', 21", 21'") being arranged along a circumference described by the rotational movement of said gripping means (23) through said rotary support structure (30), said mobile rotary structure being adapted to pick up said container or bottle (16) from said conveying means (18) with said grasping and transporting group (22), and to transport said container or bottle (16) to said at least one measuring module (21', 21", 21'") to then take said container or bottle (16) back again to a release point of said conveying means (18) once measurement has been carried out and no anomaly has been detected or to then position said container or bottle (16) at a discarding container in the case in which anomalies are found, said gripping means (23) comprising a pincer adapted to be opened and closed through a lever mechanism (27), said gripping means (23) being mobile between a gripping position, in which they are engaged with said neck of said container (16) at and below said annular ribbing (19), and a release position in which they are not engaged with said container (16), gripping means (23) being connected to and supported by mobile support structure (30) in order to perform a gripping from above the neck of container (16), wherein said mobile support structure (30) is vertically translatable in order to adjust the suspension height of said gripping means (23) and wherein said sampling control station also includes a removal or reclosing module (40) for simultaneously measuring a removal torque and a reclosing angle of a cap (28) of said container (16) connected to said grasping and transporting group (22) so as to be positioned above said gripping means (23) wherein said sampling control station (20) for a container or bottle also includes a module for measuring fill level of said container, a module for measuring weight; a module for measuring capping height; a module for measuring colour; and a module for measuring gas content and/or pressure of said container (16).

* * * * *